US009520223B2

(12) United States Patent
Yoo et al.

(10) Patent No.: US 9,520,223 B2
(45) Date of Patent: Dec. 13, 2016

(54) INDUCTOR AND METHOD FOR MANUFACTURING THE SAME

(71) Applicant: SAMSUNG ELECTRO-MECHANICS CO., LTD., Suwon-si, Gyeonggi-do (KR)

(72) Inventors: Young Seuck Yoo, Suwon-si (KR); Kang Heon Hur, Suwon-si (KR); Jin Hyuck Yang, Suwon-si (KR); Sung Kwon Wi, Suwon-si (KR); Jong Yun Lee, Suwon-si (KR); Young Do Kweon, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/223,567

(22) Filed: Mar. 24, 2014

(65) Prior Publication Data

US 2014/0285305 A1 Sep. 25, 2014

(30) Foreign Application Priority Data

Mar. 25, 2013 (KR) ..... 10-2013-0031565

(51) Int. Cl.
*H01F 5/00* (2006.01)
*H01F 27/30* (2006.01)
(Continued)

(52) U.S. Cl.
CPC ..... *H01F 27/2804* (2013.01); *H01F 27/022* (2013.01); *H01F 27/255* (2013.01);
(Continued)

(58) Field of Classification Search
CPC ..... H01F 17/0006; H01F 27/2804; H01F 17/0013; H01F 27/292; H01F 2027/2819
(Continued)

(56) References Cited

U.S. PATENT DOCUMENTS 1,647,474 A * 11/1927 Seymour ..... H03H 5/02 174/254
5,529,831 A * 6/1996 Waga ..... H01F 17/0006 360/130.23
(Continued)

FOREIGN PATENT DOCUMENTS

CN 101615479 A 12/2009
JP 2001-284125 A 10/2001
(Continued)

OTHER PUBLICATIONS

Notice of Allowance Korean Patent Application No. 10-2013-0031565 dated Jul. 15, 2014.
(Continued)

*Primary Examiner* — Alexander Talpalatski
*Assistant Examiner* — Joselito Baisa
(74) *Attorney, Agent, or Firm* — McDermott Will & Emery LLP

(57) ABSTRACT

The present invention relates to an inductor. An inductor in accordance with an embodiment of the present invention includes: an insulating layer having a hole; a conductive pattern disposed on both surfaces of the insulating layer and having a structure in which portions disposed on the both surfaces are electrically connected to each other through the hole; and a magnetic layer disposed on the insulating layer to cover the conductive pattern, wherein the conductive pattern has a plating pattern formed by performing a plating process.

9 Claims, 3 Drawing Sheets

(51) Int. Cl.
*H01F 27/28* (2006.01)
*H01F 27/02* (2006.01)
*H01F 27/255* (2006.01)
*H01F 41/04* (2006.01)
*H01F 27/29* (2006.01)

(52) U.S. Cl.
CPC ..... *H01F 41/046* (2013.01); *H01F 27/292* (2013.01); *H01F 2027/2809* (2013.01); *Y10T 29/4902* (2015.01)

(58) Field of Classification Search
USPC ..... 336/199, 200, 232
See application file for complete search history.

(56) References Cited

U.S. PATENT DOCUMENTS 5,583,474 A * 12/1996 Mizoguchi ..... H01F 17/0006 336/200
5,874,883 A * 2/1999 Uemura ..... H01F 17/0006 336/200
6,249,039 B1 * 6/2001 Harvey ..... H01F 17/0006 257/528
6,293,001 B1 * 9/2001 Uriu ..... H01F 17/0013 29/602.1
6,433,860 B1 * 8/2002 Ohishi ..... G01C 3/08 356/4.01
6,456,459 B1 * 9/2002 Sasaki ..... G11B 5/3116 360/123.47
6,631,545 B1 * 10/2003 Uriu ..... H01F 17/0013 29/602.1
6,767,477 B2 * 7/2004 Wu ..... C23F 1/18 216/105
6,802,986 B2 * 10/2004 Nakano ..... B82Y 10/00 216/13
6,927,940 B2 * 8/2005 Hsiao ..... G11B 5/3116 360/123.24
7,290,324 B2 * 11/2007 Fontana, Jr. ..... G11B 5/127 219/209
7,619,500 B1 11/2009 Nishikawa et al.
7,950,138 B2 * 5/2011 Li ..... G11B 5/1278 205/122
2003/0020583 A1 * 1/2003 Hui ..... H01F 27/365 336/200
2006/0152321 A1 * 7/2006 Jung ..... H01F 17/0006 336/200
2009/0309687 A1 * 12/2009 Aleksov ..... H01F 17/0033 336/200
2013/0222101 A1 8/2013 Ito et al.

FOREIGN PATENT DOCUMENTS

JP 2006-278909 A 10/2006
JP 2007-067214 A 3/2007
JP 2010-205905 A 9/2010
KR 10-2006-0061709 A 6/2006
KR 10-0733279 B1 6/2007
WO 2012/053439 A1 4/2012

OTHER PUBLICATIONS

Korean Office Action issued in Korean Application No. 10-2013-0031565 date Feb. 7, 2014.
Chinese Office Action dated Dec. 22, 2015 issued in Chinese Patent Application No. 201310646910.2 (English translation).

* cited by examiner

INDUCTOR AND METHOD FOR MANUFACTURING THE SAME

CROSS-REFERENCE TO RELATED APPLICATIONS

Claim and incorporate by reference domestic priority application and foreign priority application as follows:

CROSS REFERENCE TO RELATED APPLICATION

This application claims the benefit under 35 U.S.C. Section 119 of Korean Patent Application Serial No. 10-2013-0031565, entitled filed Mar. 25, 2013, which is hereby incorporated by reference in its entirety into this application."

BACKGROUND OF THE INVENTION

1. Field of the Invention

The present invention relates to an inductor and a method for manufacturing the same, and more particularly, to an inductor with improved inductance characteristics and a method for manufacturing the same.

2. Description of the Related Art

A multilayer power inductor is mainly used in a power circuit such as a DC-DC converter of a portable electronic device and particularly used in a high current due to its characteristics of suppressing magnetic saturation in terms of material and structure. Since the multilayer power inductor has a disadvantage that an inductance L value is greatly changed according to application of a current compared to a wire-wound power inductor but is advantageous to miniaturization and thinning, it can respond to the recent trend of electronic components.

A typical multilayer power inductor consists of a core layer having a coil type conductive pattern, a magnetic layer for covering the core layer, external electrodes for covering both ends of the magnetic layer, etc. Here, the conductive pattern forms a final inductor by configuring a laminate through printing of a conductive material and lamination of the magnetic layer on the core layer and pressing and sintering the laminate.

In the inductor having the above structure, the higher the magnetic material filling density of the magnetic layer, the higher the permeability of the magnetic layer. Thus, the inductance characteristics are improved. However, as for the device body of the same inductor, since the miniaturization of the coil type conductive pattern is very limited, a reduction in the thickness of the core layer can finally increase the magnetic material filling density of the magnetic layer. However, since a typical core layer is manufactured using a copper clad laminate etc. as a base, there are limitations in reducing the thickness of the core layer.

Further, the above manufacturing process of the inductor has problems such as the spread of the electrode in the printing process for forming the conductive pattern and the deformation of the previously formed conductive pattern due to the pressing and sintering processes. Particularly, the laminating and pressing processes cause the deformation in vertical alignment of the coil type conductive pattern and the sintering process causes the shrinkage of the coil type conductive pattern. The deformation of the coil type conductive pattern like this deteriorates the inductance characteristics of the inductor. Thus, it is difficult to implement low resistance high current characteristics required for a power inductor.

RELATED ART DOCUMENT

Patent Document

Patent Document 1: Korean Patent No. 10-0733279

SUMMARY OF THE INVENTION

The present invention has been invented in order to overcome the above-described problems and it is, therefore, an object of the present invention to provide an inductor and a method for manufacturing the same that can satisfy low resistance high current characteristics.

It is another object of the present invention to provide an inductor and a method for manufacturing the same that can improve inductance characteristics by increasing a magnetic material filling density of a magnetic layer to improve permeability.

It is another object of the present invention to provide a method of manufacturing an inductor that can prevent deformation of a coil type conductive pattern in a manufacturing process.

In accordance with one aspect of the present invention to achieve the object, there is provided an inductor including: an insulating layer having a hole; a conductive pattern disposed on both surfaces of the insulating layer and having a structure in which portions disposed on the both surfaces are electrically connected to each other through the hole; and a magnetic layer disposed on the insulating layer to cover the conductive pattern, wherein the conductive pattern has a plating pattern formed by performing a plating process.

In accordance with an embodiment of the present invention, the conductive pattern may have a first conductive pattern having a conducting portion formed in the hole and disposed on one surface of the insulating layer and a second conductive pattern disposed on the other surface of the insulating layer and electrically connected to the first conductive pattern through the hole, wherein the first conductive pattern may be the plating pattern.

In accordance with an embodiment of the present invention, the conductive pattern may have a metal pattern formed by etching a metal plate.

In accordance with an embodiment of the present invention, the conductive pattern may have a first conductive pattern having a conducting portion formed in the hole and disposed on one surface of the insulating layer and a second conductive pattern disposed on the other surface of the insulating layer and electrically connected to the first conductive pattern through the hole, wherein the second conductive pattern may be a metal pattern formed by etching the metal plate.

In accordance with an embodiment of the present invention, the insulating layer may have a thickness of less than 40 μm.

In accordance with an embodiment of the present invention, the conductive pattern may have a first conductive pattern having a conducting portion formed in the hole and disposed on one surface of the insulating layer, wherein the thickness of the first conductive pattern may be more than 2.5 times the thickness of the insulating layer.

In accordance with an embodiment of the present invention, the conductive patterns disposed on both sides of the insulating layer based on the insulating layer may have the same thickness.

In accordance with an embodiment of the present invention, the magnetic layer may be made of a metal-resin composite including an iron (Fe)-containing metal and a thermosetting resin.

In accordance with an embodiment of the present invention, the conductive pattern may have a multilayer coil structure disposed on the both sides of the insulating layer with the insulating layer interposed therebetween.

In accordance with another aspect of the present invention to achieve the object, there is provided a method for manufacturing an inductor, including the steps of: preparing a metal plate having an insulating layer on one surface; forming a hole, which exposes the metal plate, in the insulating layer; forming a first conductive pattern, which has a conducting portion conducted with the metal plate through the hole, on the metal plate; and forming a second conductive pattern, which is electrically connected to the first conductive pattern through the conducting portion, by patterning the metal plate.

In accordance with an embodiment of the present invention, the step of forming the first conductive pattern may be performed by performing a plating process on the metal plate.

In accordance with an embodiment of the present invention, the step of forming the second conductive pattern may include the steps of forming a resist pattern on the metal plate and performing an etching process on the metal plate by using the resist pattern as an etch stop layer.

In accordance with an embodiment of the present invention, the step of preparing the metal plate may include the steps of preparing a copper foil and forming the insulating layer on one surface of the copper foil.

In accordance with an embodiment of the present invention, the method for manufacturing an inductor may further include the steps of forming a first magnetic layer to cover the first conductive pattern before forming the second conductive pattern and forming a second magnetic layer to cover the second conductive pattern after forming the first magnetic layer.

In accordance with an embodiment of the present invention, the thickness of the second conductive pattern may be adjusted by adjusting the thickness of the metal plate.

In accordance with an embodiment of the present invention, the step of preparing the metal plate may include the step of preparing a copper foil having the same thickness as the first conductive pattern.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

Figure 1:
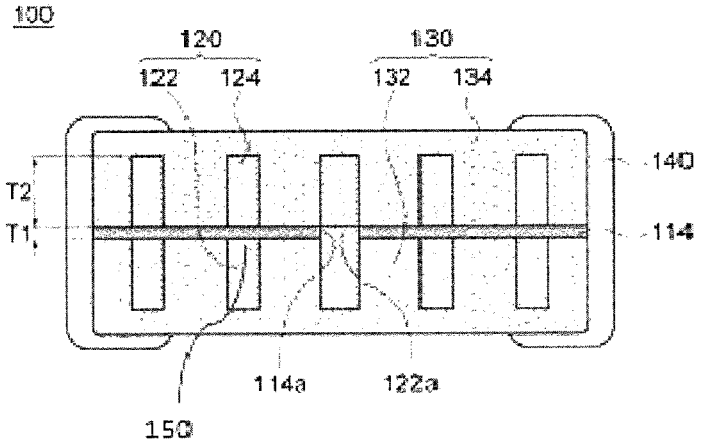
FIG. 1 is a view showing an inductor in accordance with an embodiment of the present invention.

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art. Like reference numerals refer to like elements throughout the specification.

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Further, embodiments to be described throughout the specification will be described with reference to cross-sectional views and/or plan views, which are ideal exemplary drawings of the present invention. In the drawings, the thicknesses of layers and regions may be exaggerated for the effective explanation of technical contents. Therefore, the exemplary drawings may be modified by manufacturing techniques and/or tolerances. Therefore, the embodiments of the present invention are not limited to the accompanying drawings, and can include modifications to be generated according to manufacturing processes. For example, an etched region shown at a right angle may be formed in the rounded shape or formed to have a predetermined curvature.

Hereinafter, an inductor and a method for manufacturing the same in accordance with an embodiment of the present invention will be described in detail with reference to the accompanying drawings.

FIG. 1 is a view showing an inductor in accordance with an embodiment of the present invention. Referring to FIG. 1, an inductor 100 in accordance with an embodiment of the present invention, which is a multilayer power inductor, may include an insulating layer 114, a conductive pattern 120, a magnetic layer 130, and an external electrode 140.

The insulating layer 114 may be a base for manufacture of the inductor 100. The insulating layer 114 may be a core layer which crosses the inner center of a device body of the inductor 100. At least one hole 114*a* for electrical connection of the conductive pattern 120 disposed on both surfaces of the insulating layer 114 may be formed in the insulating layer 114.

The conductive pattern 120 may be disposed on both sides of the insulating layer 114. The conductive pattern 120 may include a first conductive pattern 122 disposed on a seed layer 150 on one surface of the insulating layer 114 and a second conductive pattern 124 disposed on the other surface opposite to the one surface without a seed layer. Accordingly, the insulating layer 114 can function as an interlayer insulating layer for partitioning the first conductive pattern 122 and the second conductive pattern 124. A conducting portion 122*a* may be provided in the first conductive pattern 122 to be in contact with the second conductive pattern 124 through the hole 114*a* for electrical connection with the second conductive pattern 124. The first and second conductive patterns 122 and 124 are electrically connected to each other by the conducting portion 122*a* so that the conductive pattern 120 may have a multilayer coil form. This conductive pattern 120 may be made of various metal materials. As an example, the conductive pattern 120 may be made of silver (Ag) or copper (Cu).

The magnetic layer 130 may include a first magnetic layer 132, which covers one surface of the insulating layer 114, and a second magnetic layer 134, which covers the other surface of the insulating layer 114. Accordingly, the first magnetic layer 132 can cover the first conductive pattern 122 and the second magnetic layer 134 can cover the second conductive pattern 124.

The magnetic layer 130 may be made of a metal-resin composite material. For example, the metal-resin composite may be a metal-resin composite consisting of metal magnetic powder and an uncured thermosetting resin. The metal magnetic powder may be various metal powders having magnetism. The thermosetting resin may be an amorphous epoxy resin. The metal magnetic powder may be metal powder containing iron (Fe) and iron alloys as a base.

The external electrode 140 may cover both external ends of the device body while being electrically connected to the conductive pattern 120. The external electrode 140 may be used as an external connection terminal for electrically connecting the inductor 100 to an external electronic device (not shown).

Meanwhile, the first conductive pattern 122 may be a plating pattern formed by performing a plating process. That is, the first conductive pattern 122 may be formed by etching a plating layer which is formed by performing an electroless or electroplating process. In contrast, the second conductive pattern 124 may be formed by etching a predetermined metal plate (112 of FIG. 3*a*). For example, the second conductive pattern 124 may be a metal pattern which is formed by performing a wet etching process on a copper foil.

The above inductor 100 may have a structure in which the area of the magnetic layer 130 is relatively increased by minimizing the thickness of the insulating layer 114. More specifically, as the occupied area of the magnetic layer 130 is increased, the permeability of the inductor 100 is improved. Thus, the inductance characteristics of the device body consisting of the insulating layer 114, the conductive pattern 120, and the magnetic layer 130 can be improved. Accordingly, it is preferred to minimize the thickness T1 of the insulating layer 114. However, when using a copper clad laminate (CCL) as a base plate and forming a coil type conductive pattern on the CCL by a printing process, there are limitations in reducing the thickness of the core layer. Especially, it is very difficult to reduce the thickness of the core layer to less than 40 μm. However, since the conductive pattern 120 is formed by a plating process and an etching process on a copper foil, it is possible to adjust the thickness of the insulating layer 114 to less than 40 μm. A detail description of a process of forming the insulating layer 114 will be made later.

As described above, the inductor 100 in accordance with an embodiment of the present invention may have a structure in which the area of the magnetic layer 130 is relatively increased by reducing the thickness of the insulating layer 114 to less than 40 μm while including the insulating layer 114 having the conductive pattern 120 on the surface, the magnetic layer 130 for covering the insulating layer 114, and the external electrode 140 for covering the both external ends of the magnetic layer 130. Accordingly, the inductor in accordance with the present invention can have a structure with the improved inductance characteristics by increasing the relative occupied area of the magnetic layer in the device body of the inductor to increase a magnetic material filling density.

Hereinafter, a method for manufacturing an inductor in accordance with an embodiment of the present invention will be described in detail. Here, descriptions overlapping with those of the above-described inductor 100 may be omitted or simplified.

Figure 2:
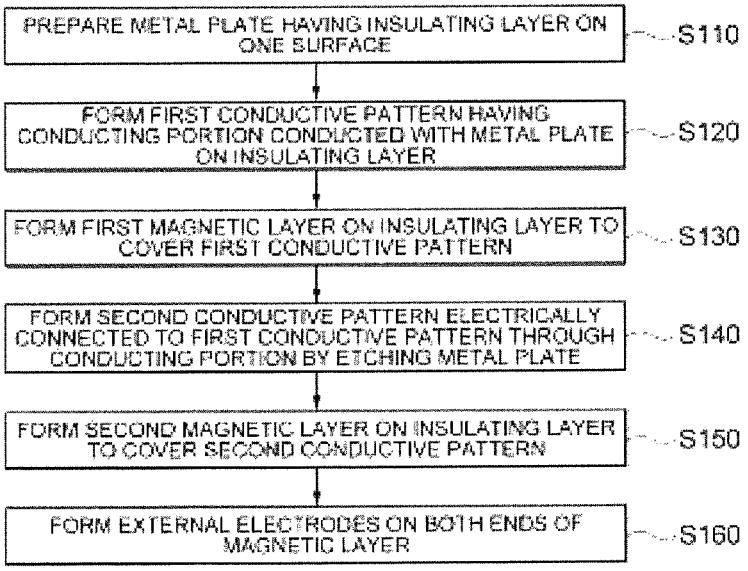
FIG. 2 is a flowchart showing a method for manufacturing an inductor in accordance with an embodiment of the present invention.

FIG. 2 is a flowchart showing a method for manufacturing an inductor in accordance with an embodiment of the present invention, and FIGS. 3*a* to 3*e* are views for explaining a process of manufacturing an inductor in accordance with an embodiment of the present invention.

Figure 3A:
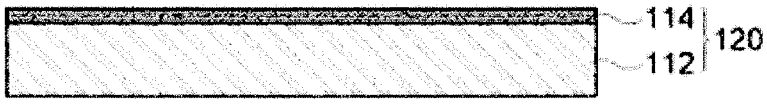
FIGS. 3*a* to 3*e* are views for explaining a process of manufacturing an inductor in accordance with an embodiment of the present invention.

Referring to FIGS. 2 and 3*a*, a metal plate 112 having an insulating layer 114 on one surface may be prepared (S110). The step of preparing the metal plate 112 may include the steps of preparing a copper foil and forming the insulating layer 114 on one surface of the copper foil. The insulating layer 114 may be used as an interlayer insulating layer of a coil type electrode pattern formed in a subsequent process.

Figure 3B:
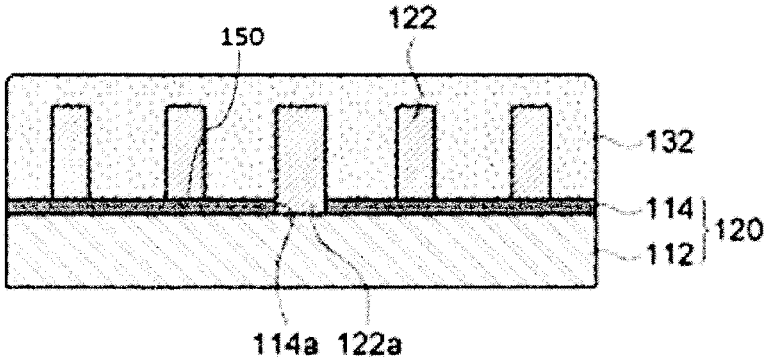

Referring to FIGS. 2 and 3*b*, a first conductive pattern 122 having a conducting portion 122*a* which is conducted with the metal plate 112 may be formed on the insulating layer 114 (S120). The step of forming the first conductive pattern 122 may include the steps of forming a hole 114*a* in the insulating layer 114 to expose the metal plate 112, forming a plating layer by performing a plating process on the insulating layer 114, and removing a portion of the plating layer.

The step of forming the plating layer may be performed by forming a seed layer 150 on the insulating layer 114 and forming the plating layer using the seed layer 150 as a seed. The step of removing the portion of the plating layer may be performed by forming an etch stop pattern on the plating layer and performing an etching process using the etch stop pattern as an etch stop layer. Accordingly, the first conductive pattern 122 having a coil shape on the insulating layer 114 while having the conducting portion 122*a* conducted with the metal plate 112 can be formed on the metal plate 112.

A first magnetic layer 132 may be formed on the insulating layer 114 to cover the first conductive pattern 122 (S130). The step of forming the first magnetic layer 132 may be performed by coating a metal-resin composite on one surface of the metal plate 112. The step of coating the metal-resin composite may be performed by using a screen printing method or laminating at least one film type magnetic sheet made of the composite.

Figure 3C:
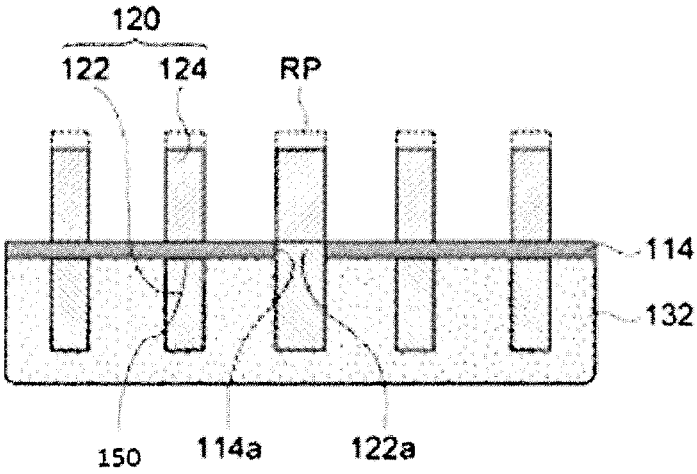

Referring to FIGS. 2 and 3*c*, a second conductive pattern 124 may be formed to be electrically connected to the first conductive pattern 122 through the conducting portion 122*a* by etching the metal plate 112 (S140). The step of forming the second conductive pattern 124 may include the steps of turning over the metal plate 112 having the first conductive pattern 122, forming a resist pattern RP on the metal plate 112, etching the metal plate 112 by using the resist pattern RP as an etch stop layer, and removing the resist pattern RP. Accordingly, an electrode pattern 120 consisting of the first conductive pattern 122 disposed on one surface of the insulating layer 114 and the second conductive pattern 124 disposed on the other surface of the insulating layer 114 to be electrically connected to the first conductive pattern 122 through the conducting portion 122*a* can be formed.

As above, the metal plate 112 may be a base plate for the formation of the second conductive pattern 124. Therefore, the thickness of the second conductive pattern 124 can be adjusted by adjustment of the thickness of the metal plate 112. As an example, when the thickness of the first conductive pattern 122 is the same as the thickness of the second conductive pattern 124, the above step of preparing the metal plate 112 may be performed by preparing a copper foil having the same thickness as the first conductive pattern 122.

Figure 3D:
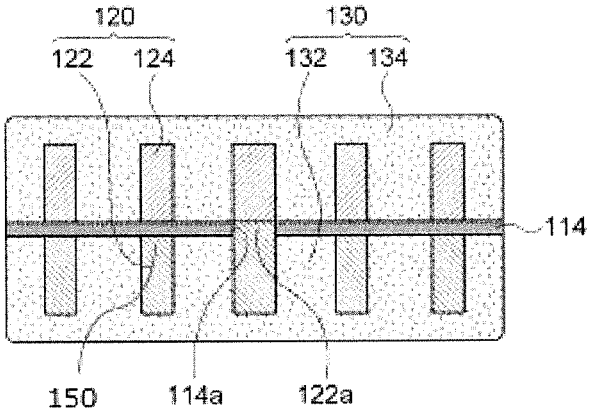

Referring to FIGS. 2 and 3*d*, a second magnetic layer 134 may be formed on the insulating layer 114 to cover the second conductive pattern 124 (S150). The step of forming the second magnetic layer 134 may be performed by coating a metal-resin composite on the other surface of the insulating layer 114. Accordingly, a magnetic layer 130 consisting of the first magnetic layer 132 and the second magnetic layer 134, which are separated from each other by the insulating layer 114, can be formed.

Figure 3E:
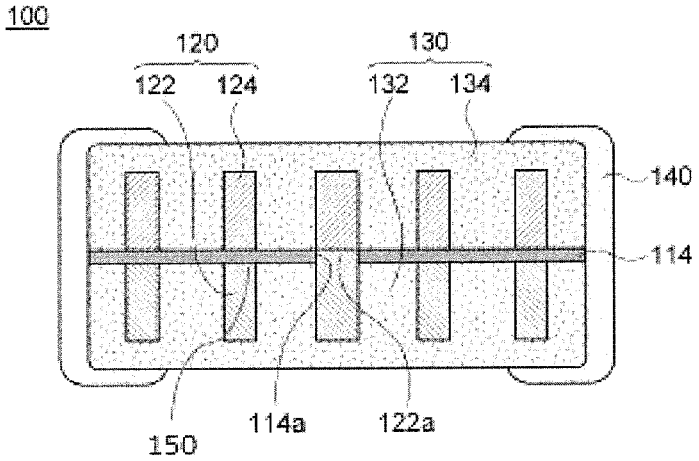

Referring to FIGS. 2 and 3*e*, an external electrode 140 may be formed on both ends of the magnetic layer 130 (S160). The step of forming the external electrode 140 may be performed by forming a metal layer, which is electrically connected to the conductive pattern 120 formed on the core layer 110, on both ends of a resultant product having the magnetic layer 130 using a plating process, a dipping process, etc.

Table 1 shows the results for inductors manufactured by the method for manufacturing an inductor in accordance with the above-described embodiment of the present invention.

TABLE 1

| Thickness (T1) of insulating layer | T1/T2 | Magnetic material filling area | Inductance (L) | Processability (present invention) |
|---|---|---|---|---|
| 100 μm | 1 | Less than 85% | Less than 5% compared to reference | Poor formation of conducting portion |
| 60 μm | 1.7 | Less than 85% | Reference | Poor formation of conducting portion |
| 40 μm | 2.5 | More than 85% | More than 5% compared to reference | Normal formation of conducting portion |
| 20 μm | 5 | More than 85% | More than 5% compared to reference | Normal formation of conducting portion |
| 10 μm | 10 | More than 85% | More than 5% compared to reference | Normal formation of conducting portion |

Referring to FIG. 1 and Table 1, it is checked that the inductor including the insulating layer 114 with the adjusted thickness T1 of about 60 μm satisfies the inductance L characteristics of a normal level. However, when the thickness T1 of the insulating layer 114 is adjusted to less than 40 μm, it is checked that the magnetic material filling area in the device body is more than about 85% as a volume ratio and the inductance value is increased by more than 5% compared to the normal level. When comparing the thickness T1 of the insulating layer with the thickness T2 of the first conductive pattern 122, it is checked that the thickness T2 of the first conductive pattern 122 satisfies the reference value when the thickness T2 of the first conductive pattern 122 is more than 1.7 times the thickness of the insulating layer 114. Particularly, when the thickness T2 of the first conductive pattern 122 is adjusted to more than 2.5 times the thickness of the insulating layer 114, it is checked that the magnetic material filling area in the device body is more than about 85% as a volume ratio and the inductance value is increased by more than 5% compared to the normal level.

Further, when manufacturing the inductor including the insulating layer with the thickness T1 of greater than 60 μm by the manufacturing method in accordance with the present invention, the manufacturing efficiency of the conducting portion 122*a* is deteriorated. Therefore, considering the manufacturing efficiency of the conducting portion 122*a*, it is preferred that the thickness T1 of the insulating layer is adjusted to less than about 40 μm.

As described above, the method for manufacturing an inductor in accordance with an embodiment of the present invention can form the coil type conductive pattern 120 by preparing the metal plate 112 having the insulating layer 114 on one surface, forming the first conductive pattern 122 on one surface of the insulating layer 114 using a plating process, and forming the second conductive pattern 124 on the other surface of the insulating layer 114 by etching the metal plate 112. In this case, compared to the prior art that forms a conductive pattern through a printing process by using a copper clad laminate as a base, it is possible to reduce the thickness of the core layer corresponding to the insulating layer, prevent the spread of the electrode in a printing process, and prevent the deformation of the conductive pattern in pressing and sintering processes. Accordingly, the method for manufacturing an inductor in accordance with the present invention can manufacture an inductor with improved inductance characteristics by increasing the relative occupied area of the magnetic layer in the device body of the inductor to increase the magnetic material filling density. Further, the method for manufacturing an inductor in accordance with the present invention can manufacture an inductor, which can implement low resistance high current characteristics, by preventing the deformation of the coil type conductive pattern and the spread of the electrode in the manufacturing process of the inductor.

The inductor in accordance with the present invention can have a structure with improved inductance characteristics by increasing the relative occupied area of the magnetic layer in the device body of the inductor to increase the magnetic material filling density.

The method for manufacturing an inductor in accordance with the present invention can manufacture an inductor, which has a structure with improved inductance characteristics, by increasing the relative occupied area of the magnetic layer in the device body of the inductor to increase the magnetic material filling density.

The method for manufacturing an inductor in accordance with the present invention can manufacture an inductor, which can implement low resistance high current characteristics, by preventing the deformation of the coil type conductive pattern and the spread of the electrode in the manufacturing process of the inductor.

The foregoing description illustrates the present invention. Additionally, the foregoing description shows and explains only the preferred embodiments of the present invention, but it is to be understood that the present invention is capable of use in various other combinations, modifications, and environments and is capable of changes and modifications within the scope of the inventive concept as expressed herein, commensurate with the above teachings and/or the skill or knowledge of the related art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. An inductor comprising:

an insulating layer having a hole;

a conductive pattern disposed on both surfaces of the insulating layer and having a structure in which portions disposed on the both surfaces are electrically connected to each other through the hole; and a magnetic layer disposed on the insulating layer to cover the conductive pattern, wherein the conductive pattern comprises a first conductive pattern having a conducting portion formed in the hole and disposed on one surface of the insulating layer; and a second conductive pattern disposed on the other surface of the insulating layer and electrically connected to the first conductive pattern through the hole, and wherein a seed layer is only disposed between one surface of the insulating layer and an upper side of the first conductive pattern, wherein the second conductive pattern is a metal plate having an opening pattern, and wherein the metal plate is in direct contact with the surface of the insulating layer without any seed layer.

2. The inductor according to claim 1, wherein the first conductive pattern is a plating pattern.

3. The inductor according to claim 1, wherein the conductive pattern has a metal pattern formed by etching a metal plate.

4. The inductor according to claim 1, wherein the second conductive pattern is a metal pattern formed by etching a metal plate.

5. The inductor according to claim 1, wherein the insulating layer has a thickness of less than 40 μm.

6. The inductor according to claim 1, wherein the conductive pattern comprises a first conductive pattern having a conducting portion formed in the hole and disposed on one surface of the insulating layer, wherein the thickness of the first conductive pattern is more than 2.5 times the thickness of the insulating layer.

7. The inductor according to claim 1, wherein the conductive patterns disposed on both sides of the insulating layer based on the insulating layer have the same thickness.

8. The inductor according to claim 1, wherein the magnetic layer is made of a metal-resin composite comprising an iron (Fe)-containing metal and a thermosetting resin.

9. The inductor according to claim 1, wherein the conductive pattern has a multilayer coil structure disposed on both sides of the insulating layer with the insulating layer interposed therebetween.

* * * * *